US008222546B2

(12) United States Patent
Leischner et al.

(10) Patent No.: US 8,222,546 B2
(45) Date of Patent: Jul. 17, 2012

(54) MULTI-POSITION ROTARY SWITCH

(75) Inventors: Manfred Leischner, Kunzelsau (DE); Rainer Schutera, Forchtenberg-Mithof (DE)

(73) Assignee: R. Stahl Schaltgeräte GmbH, Waldenberg (DE)

( * ) Notice: Subject to any disclaimer, the term of this patent is extended or adjusted under 35 U.S.C. 154(b) by 224 days.

(21) Appl. No.: 12/747,363

(22) PCT Filed: Jan. 7, 2009

(86) PCT No.: PCT/EP2009/000019

§ 371 (c)(1),
(2), (4) Date: Jun. 10, 2010

(87) PCT Pub. No.: WO2009/090001

PCT Pub. Date: Jul. 23, 2009

(65) Prior Publication Data

US 2010/0258413 A1 Oct. 14, 2010

(30) Foreign Application Priority Data

Jan. 16, 2008 (DE) ..... 10 2008 004 747

(51) Int. Cl.
*H01H 19/00* (2006.01)

(52) U.S. Cl. ..... 200/11 R

(58) Field of Classification Search ..... None
See application file for complete search history.

(56) References Cited

U.S. PATENT DOCUMENTS

| | | | | | |
|---|---|---|---|---|---|
| 2,875,287 | A | | 2/1959 | Van Sickle | |
| 3,758,734 | A | * | 9/1973 | Gartner | 200/5 R |
| 4,968,862 | A | * | 11/1990 | Maeda | 200/5 R |
| 6,072,128 | A | * | 6/2000 | Ansorge et al. | 200/5 R |

FOREIGN PATENT DOCUMENTS

| | | | |
|---|---|---|---|
| DE | 3045698 | A1 | 6/1982 |
| DE | 3827389 | A1 | 2/1990 |
| EP | 0829890 | A | 3/1998 |
| FR | 2622734 | A | 5/1989 |
| GB | 2160711 | A | 12/1985 |

* cited by examiner

*Primary Examiner* — Edwin A. Leon
(74) *Attorney, Agent, or Firm* — Leydig, Voit & Mayer, Ltd.

(57) ABSTRACT

A multi-position rotary switch comprises a plurality of identical switch chamber modules that are arranged one next to the other. Each switch chamber module holds a separate line switch allocated to a respective circuit. A standalone actuator housing holds a catch assembly for a switch shaft, which is coupled with a cam slide by means of a gear drive. The cam slide is located between a block like arrangement of switch chamber modules and the housing for the activation mechanism, which is designed for a standard configuration with three switch chamber modules connected to each other. The electrical terminals of the multi-position rotary switch are located on a narrow sides of the individual switch chamber modules.

24 Claims, 6 Drawing Sheets

MULTI-POSITION ROTARY SWITCH

CROSS-REFERENCE TO RELATED APPLICATIONS

This patent application is the national phase of PCT/EP2009/000019, filed Jan. 7, 2009, which claims the benefit of German Patent Application No. 102008004747.3, filed Jan. 16, 2008.

FIELD OF THE INVENTION

The present invention relates generally to multi-position rotary switches, and more particularly to modular constructed multi-position rotary switches.

BACKGROUND OF THE INVENTION

Multi-position rotary switches are used in the low-voltage range for switching large currents in a range of up to 180 amps. The contact force must be dimensioned according to the high current, which requires, in turn, robust housings and activation devices.

The number of required switch contacts is dictated by how many circuits are to be interrupted on the side of the user. As a rule, the number of circuits to be switched starts at three and has an open upper limit. A reasonable upper limit is 6 circuits.

It is understood that the user would not want to use a multi-position rotary switch designed for the maximum number for switching a device with fewer circuits than the maximum possible circuits within the capability of the multi-position rotary switch. Accordingly, the manufacturer of the multi-position rotary switch must provide a spectrum of different multi-position rotary switches that differ with respect to the switchable circuits but not with respect to the electrical criteria. This produces a need for multi-position rotary switches that are constructed in a modular manner by the manufacturer.

Multi-position rotary switches with a modular construction are known that are built as tiers. For activation, a switch shaft is provided that leads centrally through all of the tiers and activates switch push-rods in the individual switch chambers by means of cams. The contact tabs that connect the contacts contained in the switch chambers to the outer wiring extend from the multi-position rotary switch in a star shape accordingly. They also are located at different heights, resulting in a number of disadvantages for the user.

It is difficult to create a reasonable contact protection device for such connection tabs that project in the radial direction, since the protection device may not obstruct accessibility with tools. The connection tabs further are located at different heights, which also makes the configuration of the connection tabs difficult during the installation.

The length of such multi-position rotary switch, viewed in the direction parallel to the switch shaft, changes with the number of cam assemblies, so that the installation depth varies greatly, which require that spaces of different depths be kept available for the multi-position rotary switch.

The combination of star-shaped-projecting connection tabs and different spatial depths further does not contribute to an open arrangement and makes error-free wiring more difficult. Different structural depths have an especially disruptive effect primarily because multi-position rotary switches typically represent relatively large objects that are often are mounted on their back side, if the front side is considered to be the side on which the activation element to be activated manually sits.

OBJECTS AND SUMMARY OF THE INVENTION

It is an object of the present invention to provide an improved modular controlled multi-position rotary switch that overcomes the foregoing disadvantages. The novel multi-position rotary switch is assembled from at least one first switch chamber module and one second switch chamber module, wherein both of these modules have the same inner and outer constructions, i.e., they are structurally identical.

Each switch chamber module has, at least approximately, a right-parallelepiped shape. It is bounded by two opposing mounting sides, a top side, a bottom side, and two terminal sides. In the assembled state, the top sides of the switch chamber modules and also the bottom sides lie in a common plane, wherein the term plane is to be understood herein to be used in the technical sense and not in the mathematical sense.

Each switch chamber module contains a switch chamber that is insulated, at least electrically, from the outside. The switch contacts are activated by a switch push-rod that is guided in a borehole or opening. The borehole or opening connects the interior of the switch chamber to the top side.

Connection means are provided by means of which two switch chamber modules are attached to each other such that their mounting sides are adjacent to each other and the switch push-rods are oriented parallel to each other. For activating the switch push-rod, an activation slide is provided that is common for all of the switch chamber modules and that has a cam for each switch push-rod.

Therefore, in the case of the novel multi-position rotary switch, the switch chamber modules lie one next to the other, wherein the width, but not the structural depth, of the multi-position rotary switch changes according to the number of circuits to be switched. The structural depth remains constant independent of the number of switch chamber modules and corresponds to the height of the switch chamber module plus an optional activation housing that could also be provided. Because the switch chamber modules lie one next to the other on the top side with respect to a top view, all of the connection tabs consequently also lie at the same height, independent of which circuit is involved. This produces an open arrangement which in turn contributes to a reduction in wiring errors.

Because all of the connection tabs lie one next to the other, each connection tab is accessible with tools from the top side or the bottom side according to how the switch is constructed in detail and it is also easy to provide the connection tabs with a preferred contact protection device that increases the electrical safety without limiting accessibility.

The multi-position rotary switch according to the invention can be constructed so that it satisfies regulations for explosion protection. For this purpose, it is essentially sufficient to adapt the wall thickness of the walls that define the switch chamber to the switch chamber volume and to shape the switch push-rod together with the borehole so that an ex-gap, i.e., an ignition puncture proof gap is produced. The switch chamber is thus encapsulated in a pressure-resistant flame proof way.

Each switch chamber module advantageously can have two stationary switch contacts and one movably guided contact bridge. The contact bridge can be biased by means of springs into a closed position. This means, conversely, that the opening takes place with a positive fit with the help of the cam on the activation slide. The risk of fusing contacts is therefore minimized.

Favorable space relationships are produced when the contact bridge is oriented with its longitudinal axis parallel to the mounting side, i.e., at a right angle to the longitudinal axis of the activation slide.

The switch contacts can be provided with connection tabs that are guided outward past the adjacent connection side. The material expense for the contact tabs is therefore minimal.

In order to be able to guarantee contact protection, a protective device can be provided into which the contact tab projects. The terminal and protective device can be constructed as a clip-on part that is connected to the switch chamber module without additional, separate connection means, such as screws or the like.

The switch push-rod can be guided captively in the switch chamber module, for example, in that it has a head that lies in the switch chamber and has a diameter greater than the shaft of the push-rod guided outward through the borehole. Alternatively, a retaining ring can also sit on the push-rod, wherein this ring fulfills the function of the head.

The connection means for connecting the switch chamber modules can consist of a dovetail-like shaped projection on one side of the switch chamber module. On the opposing mounting side, a pocket is provided with a similar dovetail-like outline corresponds to the projection. This pocket is open toward the side and upward or downward, so that the projection can be inserted perpendicular to the pocket direction.

In the region of this dovetail-shaped projection, in the assembled state, two switch chamber modules are connected to each other with a positive fit. They are held together in the direction parallel to the mounting side and perpendicular to the mounting side.

The projection or the associated pocket is advantageously arranged in the bottom side, which permits the possibility of holding the switch chamber modules together with the help of an optional cover on the top side of the multi-position rotary switch, while additional parts for attachment to the bottom side are unnecessary.

In the region of the top side of the switch chamber modules, a pocket can be provided as connection means that interacts with corresponding projections on an activation housing.

For attachment purposes, the multi-position rotary switch can be equipped with two attachment flanges for each switch chamber module. The attachment flanges project from the connection side and their bottom side is at least flush with the bottom side of the switch chamber module or the bottom side of the switch chamber module is set back relative to the bottom side of the attachment projections or flanges. A terminal protection device referred to above can also be anchored on the top side of the attachment flange.

In order to guide the activation slide securely, a corresponding guide groove can be provided in the top side of each switch chamber module. The guide grooves of the switch chamber modules are aligned when the multi-position rotary switches are assembled. By forming the guide groove in the top side, the correct guidance of the activation slide relative to the switch push-rod is assured.

For activating the multi-position rotary switch, a manual activation element can be provided. An activation housing can be provided for the manual activation element, which can be arranged on the top side. The activation housing can be shaped like a bowl and can be essentially open in the direction toward the top side of the switch chamber modules. The activation housing can have, on its bottom side, connection means with which the switch chamber modules are fixed in the region of its top side. The activation housing, for example, can be secured by means of screws on the switch chamber modules.

Preferably, the multi-position rotary switch is constructed for at least three circuits, i.e., it has three switch chamber modules as the minimum number. Under these circumstances, it is preferable if the activation housing is adapted to the width of these three switch chamber modules arranged one next to the other. If more switch chamber modules are needed by manufacturer, namely four or five modules, then additional housings could be arranged next to the activation housing, which furthermore produces overall an appealing exterior.

In the activation housing, a catch assembly can be held that is closed, for example, with an intermediate base, relative to the top side of the switch chamber modules. The catch assembly is advantageously constructed in a star shape.

As a manual activation element, a switch shaft can be used like those that are provided in multi-position rotary switches according to the prior art. The advantage of the switch shaft is that the activation motion can be easily transferred through the other housing walls, which is problematic for slide applications.

For transferring the rotational motion of the switch shaft to the activation slide, a toothed wheel with at least one tooth can be provided on the switch shaft and a toothed rack with at least one tooth gap can be provided on the activation slide.

By reason of the modular construction of the novel multi-position rotary switch, it is advantageous if the activation slide is assembled from a core section and expansion sections that are used when the number of switch chamber modules exceeds the number for which the core section had been designed. The activation slide can have at least one additional switch cam for activating an auxiliary switch unit, wherein the activation path that the switch cam generates runs parallel to the top side of the switch chamber modules, while the main activation direction lies perpendicular to the top side. At least one auxiliary switch unit also can be provided, which can be held in a receptacle space of the activation housing.

Other objects and advantages of the invention will become apparent upon reading the following detailed description and upon reference to the drawings, in which:

Figure 1:
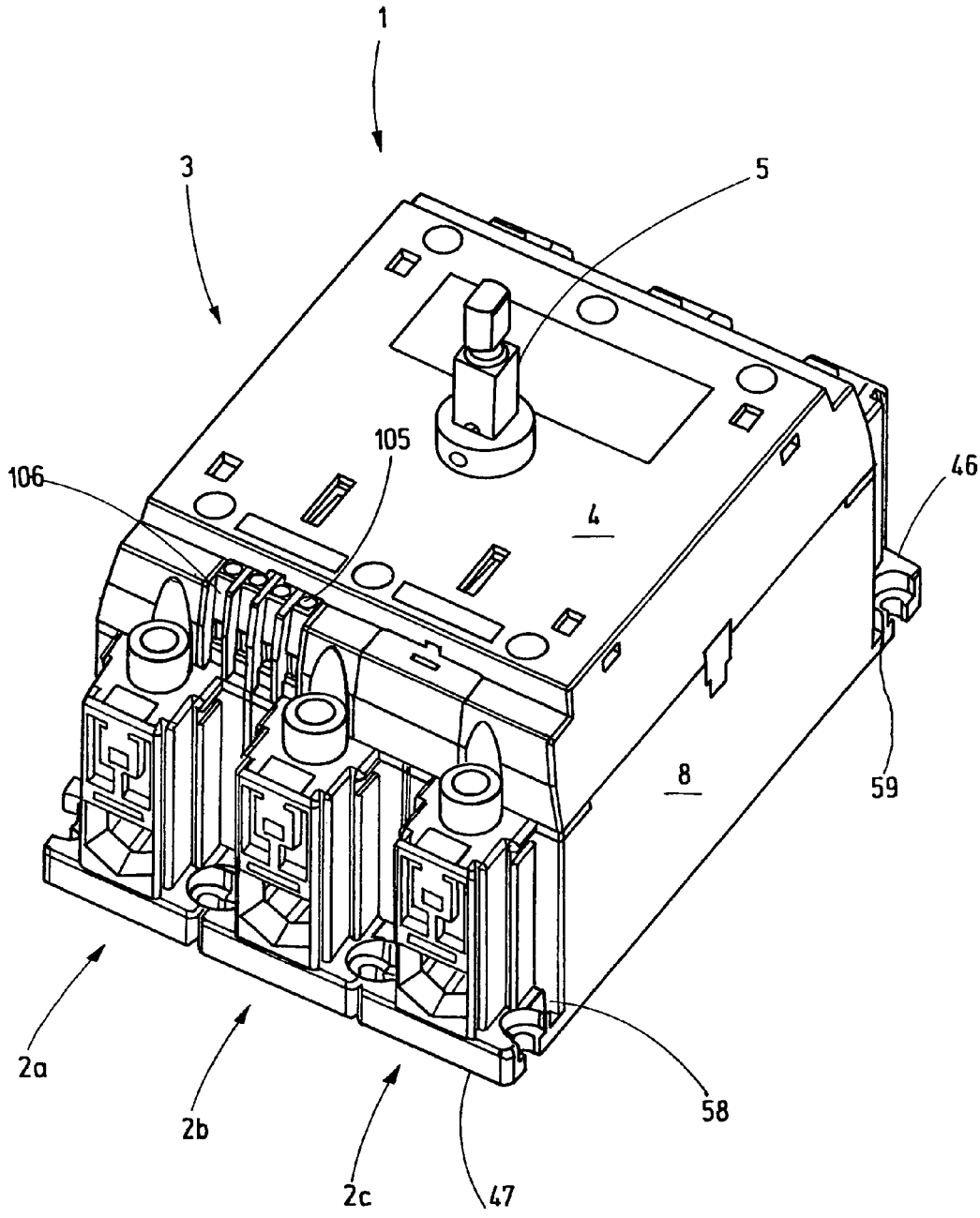
FIG. 1 is a perspective of a multi-position rotary switch in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention. It will be apparent that additional details that are not described can be taken from the drawing in a conventional way, with the drawing supplementing the description in that respect. It is clear that a series of modifications also are possible that are suggested directly to someone skilled in the art, for example, with respect to dimensioning.

The following figures, furthermore, are not necessarily to scale. For illustrating details, certain areas can possibly be shown disproportionately large. In addition, the drawings may be simplified and do not contain every detail for practical implementation. The terms "top" and "bottom" relate to the diagram of the multi-position rotary switch in FIG. 1. For the multi-position rotary switch, the top is the side on which the switch shaft is located. Furthermore, not every detail that is to be seen in the drawing is described, because someone skilled in the art will be familiar with multi-position rotary switches.

DESCRIPTION OF THE PREFERRED EMBODIMENTS

Referring now more particularly to FIG. 1 of the drawings, there is shown an illustrative multi-position rotary switch 1 in accordance with the invention that includes, as main groups, three switch chamber modules 2*a*, 2*b*, 2*c*, as well as an activation mechanism 3 arranged on the top side, with a switch shaft 5 projecting upward from its top side 4. The switch chamber modules 2*a*, 2*b*, and 2*c* are equal to each other and lie, as can be seen in the figure, side to side without a gap therebetween. They can be lined up one next to the other in unlimited numbers, as will be explained below with reference to FIG. 6. In this way, the multi-position rotary switch 1 can be expanded in a modular way, in order to be able to switch an arbitrary number of load circuits that are separated from each other galvanically. Each switch chamber module 2 with a respective circuit and contains a one-pole switch.

Figure 2:
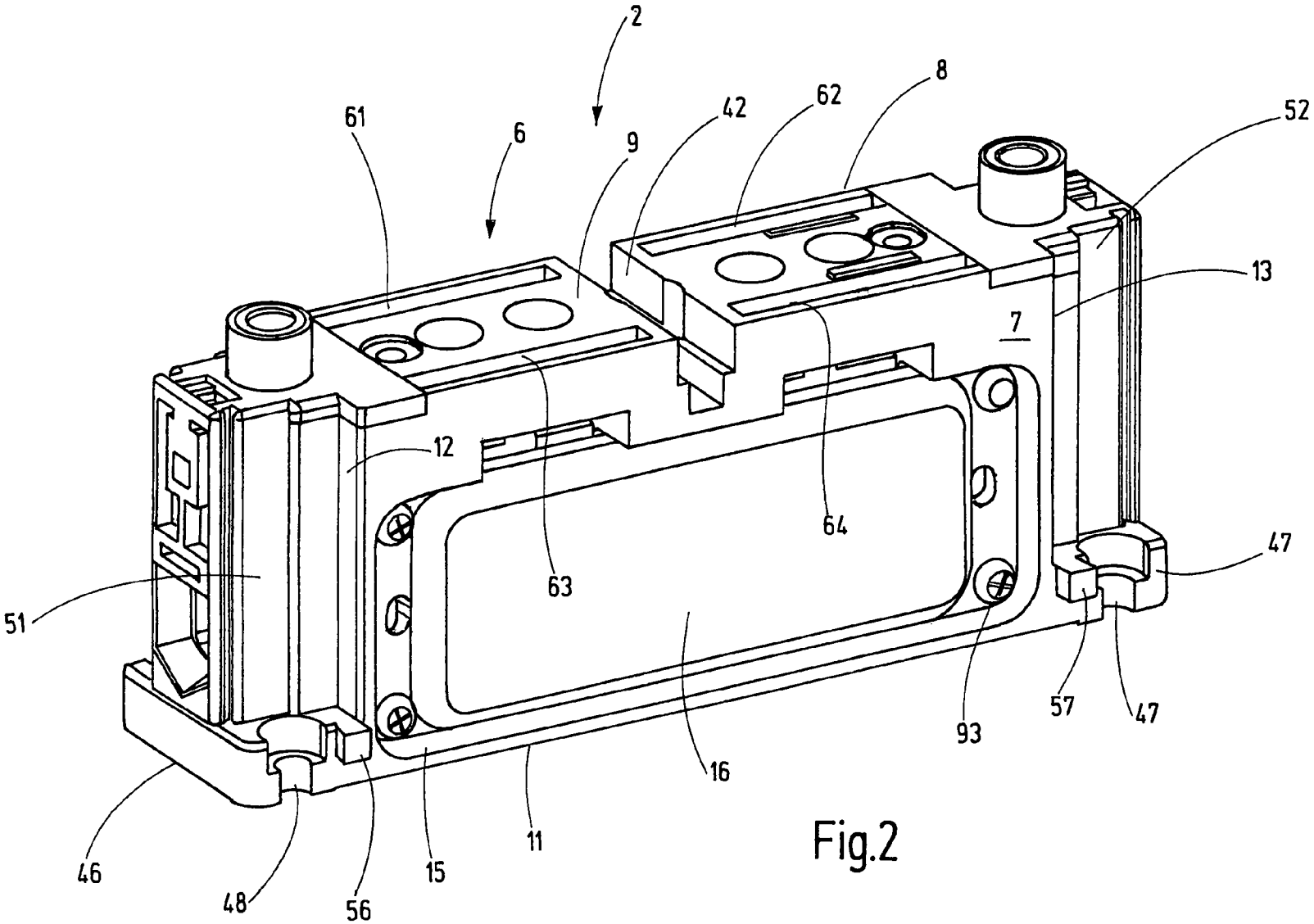
FIG. 2 is a perspective of the switch chamber modules of the illustrated multi-position rotary switch.
Figure 3:
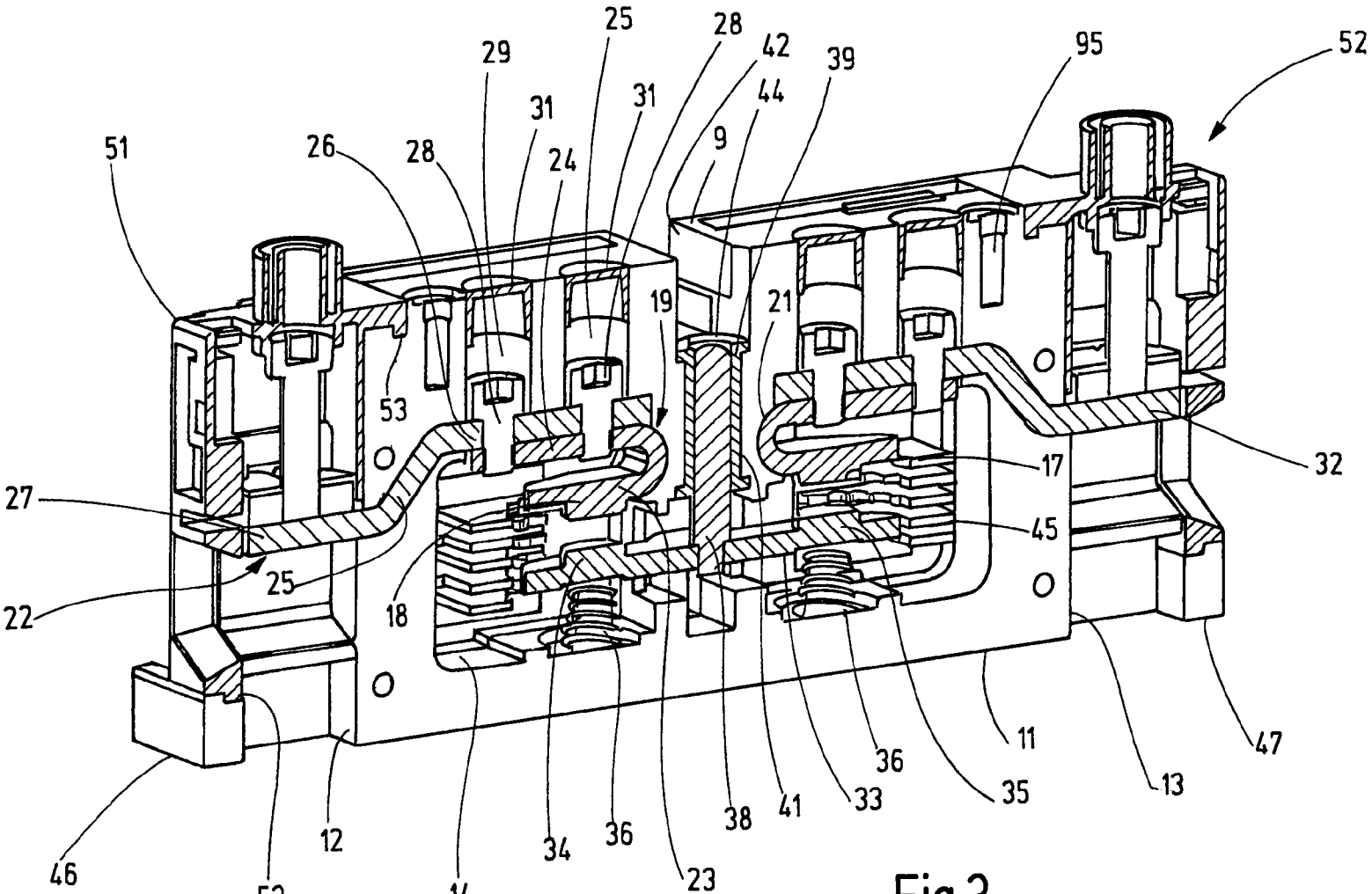
FIG. 3 is a perspective, in longitudinal section, of the module shown in FIG. 2.

The construction of the switch chamber module 2 is more particularly depicted in FIGS. 2 and 3, while in FIG. 3, not all of the section surfaces are cross-hatched in order to simplify a clear arrangement. By leaving out certain cross-hatching, especially of the main section face, the orientation of the module is easier to understand.

As can be seen from these figures, the switch chamber module 2 has a housing 6 with the shape of an approximate right parallelepiped bounded by two large flat sides, the sides 7,8 described below as mounting sides, a top side 9, a bottom side 11, and two connection sides 12,13. The two mounting sides 7 and 8 are those sides on which the switch chamber modules 2 contact each other in the assembled state. The top side 9 is oriented toward the activation mechanism 3, while the bottom side 11 faces away from and runs essentially parallel to the top side. The top side 8, the bottom side 11, as well as the two structurally identical connection sides 12, 13 form the narrow sides of the right parallelepiped.

The switch chamber module 2 has a switch chamber 14 that is counterbored into the mounting side 7 as a pocket 15 and is closed with a cover 16. The pocket 15 thus opens in the direction toward the mounting side 7.

In the interior of the switch chamber 14 are two stationary switch contacts 17,18 that are integral components of contact tabs 19,21, respectively. An additional contact tab 22 is screwed to the contact tab 19 and projects from the base body 6 toward the mounting side 12. The contact tab 19 is bent like a U and forms a leg 23 as well as an additional leg 24 that both run parallel to each other and parallel to the top side 9. The leg 23 carries the downward pointing contact 18.

The contact or connection tab 22 is flanged and runs with a section 25 at an angle through the plastic material of the base body 6. An inner section 26 lies parallel to the leg 24, while a section 27 projects from the base body 6. The connection tab 22 is screwed to the contact tab 24 by means of two screws 28. The screws 28 lead through the section 26 and into threaded boreholes in the leg 24.

It will be understood that the reason for the foregoing arrangement is to facilitate production. During production, in the injection-molding process the connection tab 22 is molded, and it is sufficient to use a simple mold core that keeps the area of the pocket 15 free, and for the contacts on the other side there is a downward-pointing flat side of the section 26 of the connection tab 22. After the injection molding, the contact tab 19 is screwed on with the help of the screws 28 that are arranged countersunk in corresponding boreholes 29. The boreholes are then closed by cover 31.

The shape of the contact tab 21 with the associated connection tab 32 is similar with that of the contact tab 18 and the connection tab 22. The difference consists only in that the contact tab 21 and the connection tab 32 are installed mirror-symmetric to each other and the connection tab 32 projects from the connection side 13. Outside the base body 6, the connection tabs 32 and 22 are located at the same height.

In the interior of the switch chamber 14, there is furthermore a moving contact bridge 33 with integral two contacts 34, 35 that correspond to the contacts 17,18. The contact bridge 33 is biased in the direction toward the contacts 17,18 by two conical springs 36 arranged underneath the contacts 34,35.

For moving the contact bridge 33 in an opening direction, there is a switch push-rod 38 whose lower end is assembled/riveted, as shown, to the contact bridge 33. The switch push-rod 38 is guided in a metal bushing 39 that is embedded in a passage borehole 41 similar to a tubular rivet or hollow rivet. The receptacle borehole 41 leads from the approximately right-parallelepiped-shaped pocket 15 centrally between the two stationary contacts 17,18 to the top side 9 and opens there into a transverse groove 42 in which is guided an activation slide 43 as described below.

The guide bushing 39 is connected to the base body 6 with a material press fit connection due to the production process. Together with the switch push-rod 38, its borehole 44 forms an ex-gap that prevents open sparks generated in the interior of the switch chamber 14 from being able to ignite a flammable gas mixture in the surroundings of the multi-position rotary switch 1. Metal plates 45 further are embedded in the switch chamber 14 as electric-arc extinguishing elements.

For mounting the multi-position rotary switch 1, there are two attachment flanges or feet 46,47 that project from the connection sides 12,13, respectively, and whose bottom side is flush with the bottom side 11. Attachment feet 46,47 have at a distance to the relevant connection side 12, 13, two attachment grooves 48 that are open toward the side and that expand into a sunken borehole for two adjacent switch chamber modules 2.

As contact protection for the outer sections 27 of the connection tabs 22,32, there are protective housings 51,52, respectively, that are constructed as clip-on parts. They are anchored on the base body 6 with ribs that mate with corresponding receptacle grooves 53 in the base body 6 or the attachment feet 46,47. In the contact-protection housings 51, 52 are corresponding openings, in order to allow the insertion of connection wires and activation tools.

The cover 16 that closes the switch chamber 14 on one side is cast with the base body 6. For this purpose, the pocket 15 has a surrounding fold 54 provided with a groove, as to be seen in FIG. 5. In this fold 54, the cover 15 sits in a counterbored manner, wherein the cover projects with a peripheral collar 55 into the groove of the fold 54 and is cast there.

In order to connect adjacent switch chamber modules 2 to each other in the region next to the bottom side 11, there are two dovetail-shaped projections 56,57. The dovetail-shaped projection 56 projects on the side of the mounting side 7 from the flank of the attachment foot 53 at this position, as shown. The projection 56 has a dovetail-like shape in the sense that it has a larger cross-sectional area on its head, i.e., at a distance from the mounting side 6, than at its base, where it transitions into the attachment foot 46. The projection 56, whose shape is best depicted in FIG. 2, is constructed so that height of the cross section above the length of the projection 56 remains constant, while the width increases with increasing distance from the mounting face 7. The dovetail-shaped projection 57 has a mirror-symmetric construction in the same way. The sole difference is that it projects from the attachment foot 47.

Figure 4:
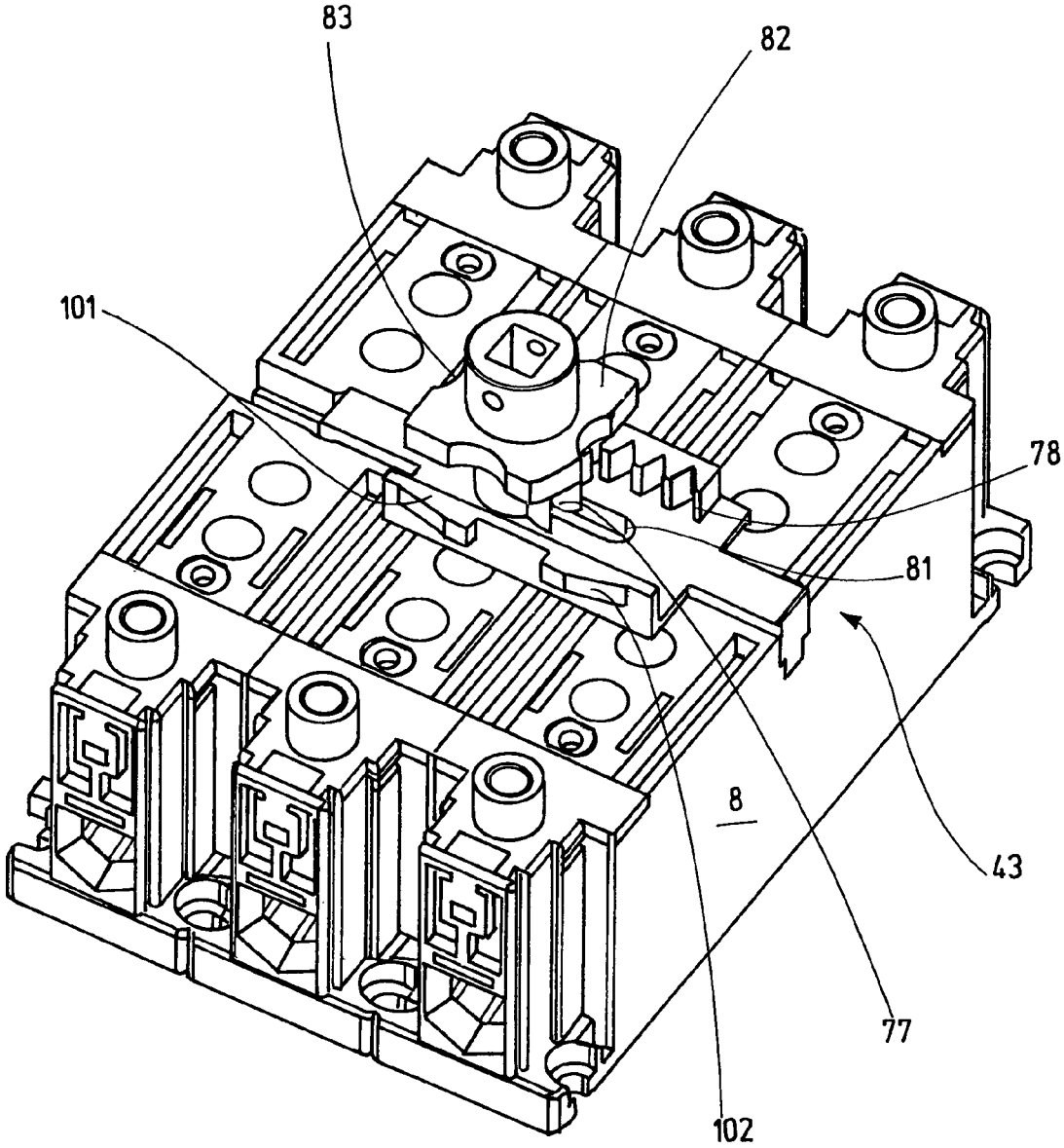
FIG. 4 is a perspective of the illustrated multi-position rotary switch with the activation housing thereof removed.

Corresponding to each projection 56, 57, the relevant attachment foot 46 or 47 has on the other side away from the mounting side 8, an open pocket 58 or 59, as seen in FIGS. 1 and 4. The pockets also open upward and have, seen from above, an outline that corresponds to the outline of the projection 56 or 57, also seen from above. In this way, two adjacent switch chamber modules 2 can be connected to each other in the vicinity of the bottom side 11 by a short downward insertion movement from above in the region next to the bottom side 11.

The connection on the top side 9 is effected with the help of the activation mechanism 3. For this purpose, each switch chamber module 2 has in the top side 9, in addition to the guide groove 42, a total of four slot-shaped pockets 61, 62, 63, and 64. Corresponding tabs that are provided on the activation mechanism 3 engage in these pockets, as depicted in the drawings.

Figure 5:
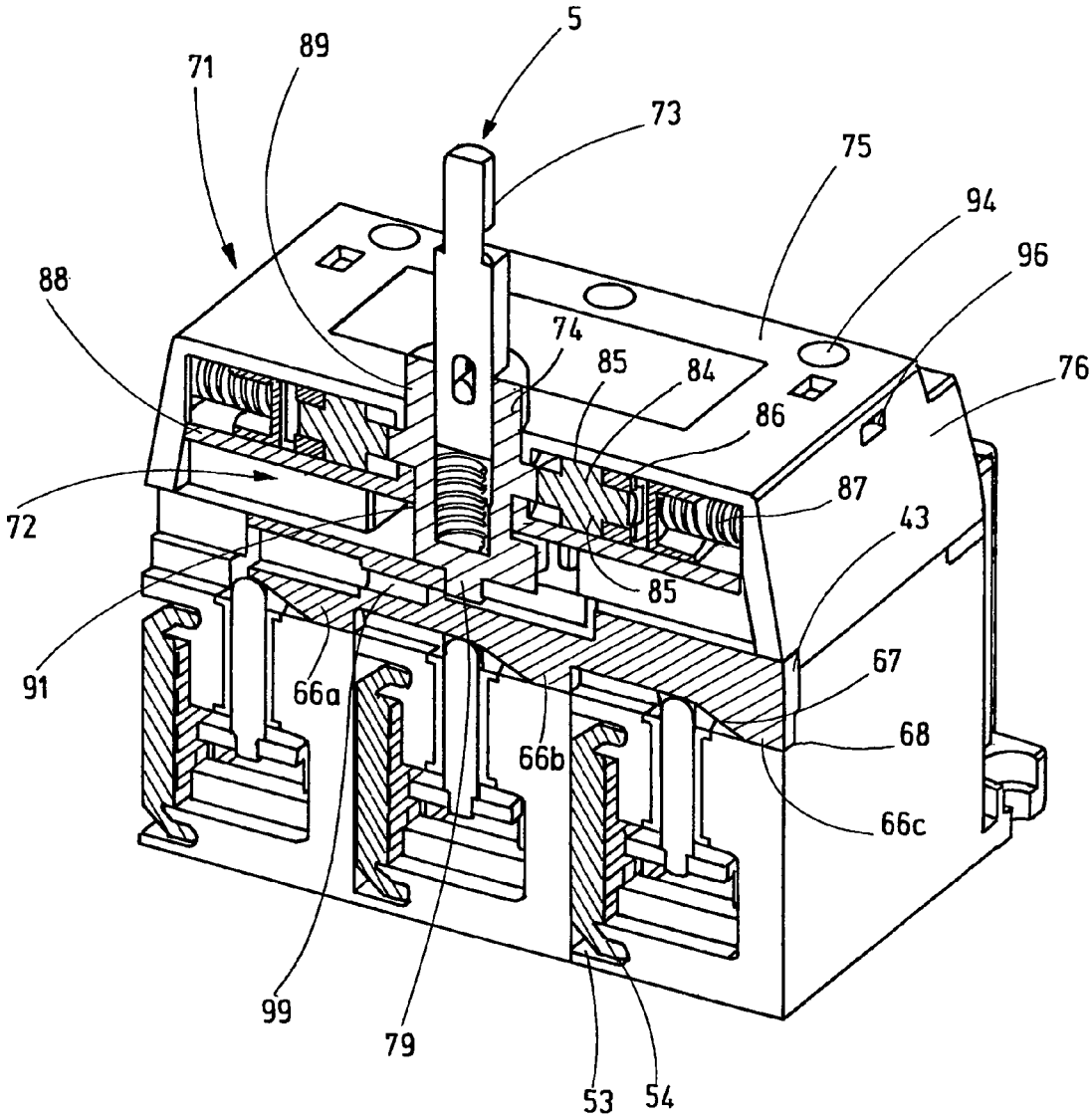
FIG. 5 is a vertical section of the multi-position rotary switch shown in FIG. 1, taken in a plane through the activation switch thereof.

In the mounted state, the individual grooves 42 on the top side of the block of the contacted switch chamber modules form a continuous groove, as is to be seen in FIG. 4. In this groove, the activation slide 43 is guided in a sliding way. The activation slide 43 is adapted to the cross-sectional profile of the groove 42 and it carries, on its bottom side for each switch chamber module, a cam 66*a*, 66*b*, and 66*c* (FIG. 5). The cams are an angled flank face 67 on one side and end at a peak area 68. FIG. 5 shows the activated state. Here, the switch push-rods 38 of all of the switch chamber modules 2*a* . . . 2*c* are next to the cams 66*a* . . . 66*c*, so that the compression springs 36 contained in each switch chamber 14 can press the contact bridge 33 upward in the direction toward the stationary contacts. In this way, the electrical connection from the connection tab 22 via the contact bridge 33 to the connection tab 32 is produced. When the activation slide is pushed starting, as depicted in FIG. 5, toward its left end position, the free ends of the switch push-rods 38 slide along the angled flank surfaces 57 until they finally come to lie on the peak surfaces 68. Because the cams 66 point downward, the peak surface 68 is close to the bottom side, i.e., the switch push-rods 38 are pressed downward and therefore the contact bridge 33 moves against the effect of the compression springs 36 away from the stationary contacts 17 and 18. The electrical connection between the connection tabs 22 and 32 is broken.

As can be seen, the activation slide 43 is aligned with the groove 42 with little play. The activation slide 43 represents the functional link between the switch chamber modules 2 and the activation mechanism 3. A bowl-shaped housing 71, the switch shaft 5, and a star-shaped catch assembly 72 are all associated with the activation mechanism 3. The switch shaft 5 in this case has a two-part construction and is made from an outer section 73 with a flattened edge and a hub part 74 that is supported within the housing 71 so that it can rotate.

The bowl-shaped housing 71 has a top side or roof 75 and a peripheral collar 76. With the free edge of the collar 76, the housing 71 open at the bottom sits on the block made from switch chamber modules 2 in a line one next to the other. Parts of the collar 76 form tabs that engage in slot-shaped pockets 61 . . . 64 that lie farthest outside on the edge of the block made from switch chamber modules 2*a* . . . 2*c*.

The hub part 74 of the switch shaft 5 carries on its bottom end a section of a pinion having teeth 77 that meshes with a toothed rack 78 (FIG. 4) that is formed on the top side or on the back of the activation slide 43. The longitudinal shaft of the switch shaft hub 74 is perpendicular to the plane defined by the top sides 9 of the switch chamber modules 2*a* . . . 2*c* and it is guided centrally through the groove 42 of the middle switch chamber module 2*b*. Accordingly, the toothed rack 78 is offset to the side and located on a side projection of the activation slide 43 above the top sides 9 of the narrow chamber modules 2*a* . . . 2*c*. As a mounting and support aid, the switch shaft hub 74 is provided with a cylindrical pin 79 that engages in a groove 81 in the top side of the activation slide 43. As a result of such arrangement, a rotational movement of the switch shaft hub 74 causes a longitudinal shift in the activation slide 43.

The teeth 77 extend across a peripheral angle of approximately more than 90° corresponding to the rotational angle of the switch shaft 5 between the deactivated position and the activated position.

A cam plate 82 that is approximately square is formed integrally on the switch shaft hub 74 and is located, as shown, above the teeth 77. In the lateral flank faces or narrow sides of the cam plate 82, there are, overall, four partial cylindrical recesses 83 that lie centrally between the corners of the cam plate 82.

Furthermore, a total of two catch rollers 84 are associated with the catch assembly 72, as depicted in FIG. 5. The catch rollers 84 are cylindrical rollers and have an outer diameter corresponding to a partial-cylindrical recess 83 (FIG. 4). They lie flat in the plane of the square cam disk 82 and carry an axle pin 85 coaxially on each side. With these axle pins 85, they lie in corresponding partial-cylindrical recesses of biasing slides 86 that are biased with the help of spiral compression springs 87 in the direction toward the switch shaft hub 74. The biasing slides 86 have corresponding receptacle pockets pointing in the direction toward the collar 76 for holding the spiral compression spring 87.

For mounting the catch assembly 72 in place, an intermediate base 88 is provided that runs at a distance to the top side or the roof 75 of the bowl-shaped housing 71. In the space between the intermediate base and the base of the bowl-shaped housing 41, the catch rollers 84, the biasing slide 76, the compression springs 87 are disposed, as well as the cam disk 82 of the switch shaft hub 74.

As a person skilled will understand, the support of the switch shaft hub 74 is effected on one side in a cylindrical borehole 89 in the roof 75 of the housing 71 and on the other side in a keyhole-shaped opening 91 in the intermediate base 88. The opening 91 thus has a keyhole shape, so that, during assembly, the teeth 77 can be guided through that have a greater diameter than the hub 74. The keyhole-shaped opening is oriented so that the switch shaft hub 74 can be supported against the base or the edge of the opening when forces that attempt to disengage the teeth occur between the pinion teeth 77 and the toothed rack 78.

Rotation on the switch shaft 5 also rotates the switch shaft hub 74. The cam plate 82 follows the rotational movement and forces the catch roller outward in the radial direction against the effect of the spiral compression springs 87. The rotational movement simultaneously rotates the pinion-shaped teeth 77, which shifts the activation slide 43 in the desired direction by means of the engagement with the toothed rack 78. After the peaks of the square catch plate 82 have passed the catch rollers 84, the catch assembly 72 generates a torque that supports the rotational movement through manual activation in the direction of the desired rotation.

At the end of the rotational movement, either the cams 66 are opposite the switch push-rods 38 and hold the switches in the switch chamber modules 2 open or the cams 66 are next to the push-rods, so that the compression springs 36 can close the switches in the switch chambers 14.

The production of the switch chamber modules 2 is generally as follows:

The connection tabs 22,32, as well as the sheet-metal assemblies 45 and the guide bushing 39 are placed in an injection mold. Then the mold cavity is closed and the plastic material is injected into the cavity. This arrangement produces the base body 6 with the integrally molded attachment feet 46 and 47.

After the ejection, the contact tabs 17,18 are screwed on, the contact bridge 33 is inserted, the spiral compression springs 36 are mounted, and the switch push-rod 38 that fits with a corresponding pin in a matching borehole in the contact bridge 33 is introduced. The plug-in connection can be a friction-fit connection that provides a captive connection of the switch push-rod 38 during the further assembly process.

As soon as the base body 6 is prepared in this way and equipped, it is placed on the mounting side 8 and the peripheral groove 55 in the fold 54 is filled with a small amount of fluid plastic. While the plastic is still fluid, the cover 16 is placed and screwed with corresponding screws 93. After hardening of the plastic in the groove 55, the cover 16 is cast on its edge projecting into the groove 55 with the base body 6. Alternatively, the groove 55 can be eliminated. In this case, the cover 16 is set in the fold 54 and screwed. Then the fluid plastic is cast into the groove between the cover 16 and the edge of the fold 54.

After the bonding of the cover 16, the preassembled protective shields 51,52 which represent contact protection and are constructed as clip-on parts, are attached. The switch chamber module 2 is thus completed and can be assembled with additional switch chamber modules corresponding to the number of load circuits to be switched. For this purpose, the switch chamber modules 2 are assembled mounting side to mounting side, in that the dovetail-shaped projections 56, 57 are inserted from above into the dovetail-shaped receptacle pockets 58, 59 of the other switch chamber module. Then the activation slide 43 is set in alignment with the grooves 42.

The activation mechanism produced as a separate structural unit, consisting of the bowl-shaped housing 71 and the catch assembly 72 held in this housing, is set from above onto the prepared block made from switch chamber modules, wherein the tabs formed on the collar 76 engage in the corresponding slot-shaped pockets 61 . . . 64 of the outer switch chamber modules 2. Finally, the activation mechanism 3 is fixed with the aid of screws on the switch chamber modules 2. The screws are here inserted into stepped boreholes 94 of the housing 71 and screwed into blind boreholes 95 that are guided from the top side 9 in each switch chamber module. As an alternative or addition to the pockets 61 . . . 64, peripheral ribs could be formed around the boreholes 94, wherein these ribs engage in corresponding recesses in the blind boreholes 95 in order to guarantee the positive-fit connection.

Figure 6:
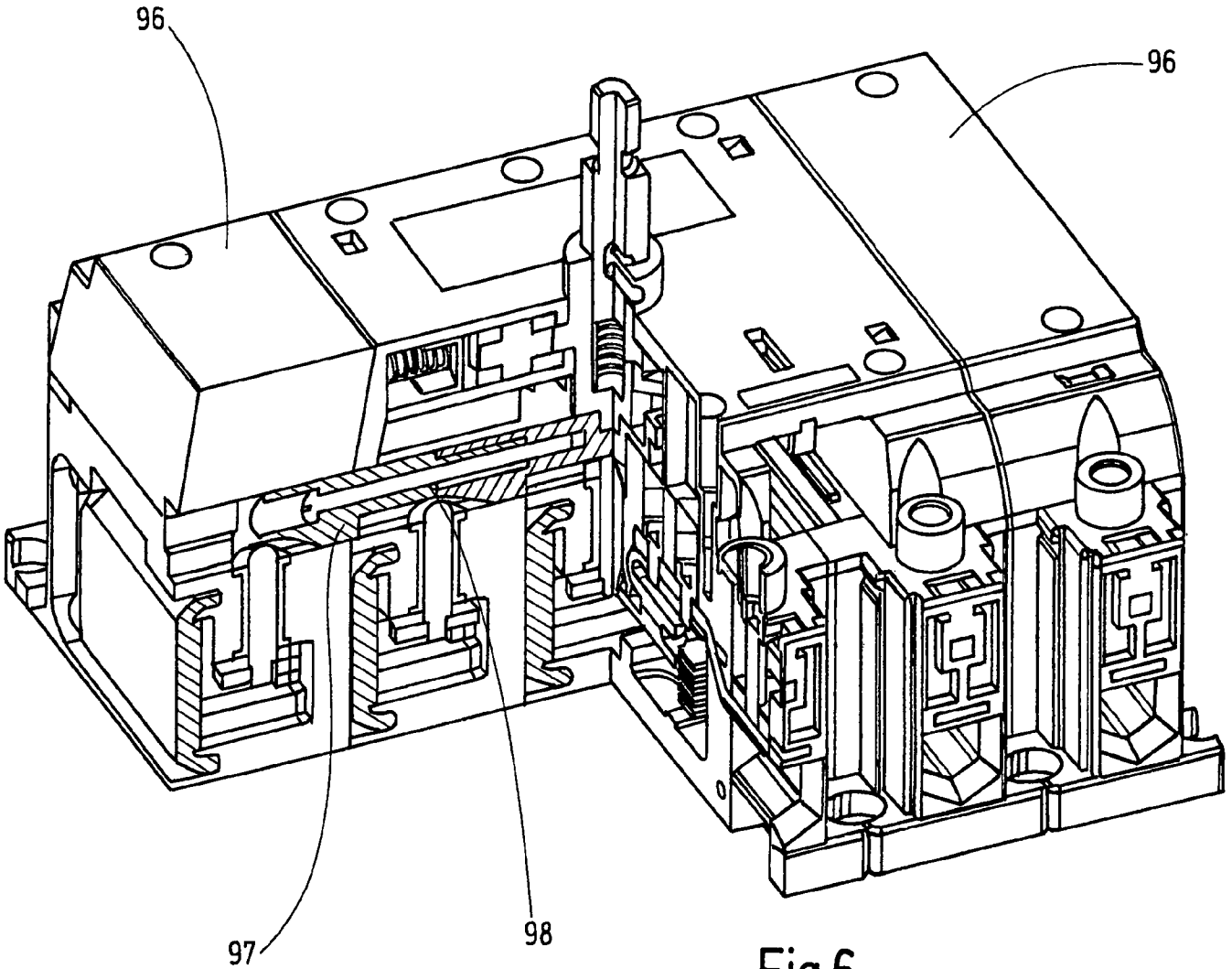
FIG. 6 is a multi-position rotary switch that is expanded by two additional switch modules, as compared with rotary position switch shown in FIG. 1, (and is a perspective, in partial section, of a multi-position rotary switch).

In the illustrated embodiment, the activation mechanism 2 is dimensioned with its housing 71 so that it is designed for attachment to a block made from three switch chamber modules 2. If more than three switch chamber modules are needed, the extension can be effected symmetrically on both sides, as depicted in FIG. 6. In addition to each switch chamber module, an additional switch chamber module is attached in the way that has been explained. In addition, housing extensions 96 are used that are provided laterally next to the housing 71 in the activation device 2 and that are screwed on one side with the additional switch chamber modules 2 and are also locked by corresponding hook connections in lateral openings 96 of the collar 76 of the bowl-shaped housing 71.

In addition, the slide 43 can be provided on both sides with an extension 97. The extension 97 has the same cross section as the slide 43 for the modules 2*a* to 2*c*. For the extension, a continuous screw 98 is used that is led through a stepped borehole in the extension 97 and is screwed into a blind borehole 99 of the core part of the slide 43.

Finally, it is possible to provide on the slide 43 lying opposite the toothed rack 78 two additional control cams 101,102 that can be used to activate auxiliary switches. For this purpose, the bowl-shaped housing 71 contains, for example, on one side of the collar 76, insert openings 105 that are located at the height of the additional activation cams 101, 102. Switch units preassembled in housings 106 can be inserted into these insert openings 105. With the help of these switch units, for example, the switch position of the multi-position rotary switch 1 can then be reported to any of the other monitoring devices.

From the foregoing, it can be seen that a multi-position rotary switch is provided that consists of several switch chamber modules arranged one next to the other and that have similar constructions relative to each other. Each switch chamber module contains a separate line switch allocated to a circuit. In a standalone activation housing, a catch assembly for a switch shaft is captively held. The switch shaft is coupled with a cam slide by means of a toothed drive. The cam slide is located between the block made from switch chamber modules and the housing for the activation mechanism. The housing for the activation mechanism is designed for a standard construction of the multi-position rotary switch with three switch chamber modules connected to each other. The electrical terminals of the multi-position rotary switch are located on the narrow sides of the individual switch chamber modules. Thus, terminals are provided on two sides for finished multi-position rotary switches, wherein the terminals lie at the same height on one side.

The invention claimed is:

1. A Multi-position rotary switch (1) comprising:

at least first and second switch chamber modules (2) having the same outer and inner constructions, said switch chamber modules (2) each being shaped substantially as a right parallelepiped, said switch chamber modules (2) each having two opposing mounting sides (7, 8), a top side (9), a bottom side (11), and two connection sides (12, 13) which define together a switch chamber (14), and said switch chamber modules (2) each having a switch push-rod (38) guided for movement in a borehole (38, 44) connecting the switch chamber (14) to the top side (9) of the module, a connection device (56,57,58,59) connecting the switch chamber modules together with their mounting sides (7, 8) adjacent to each other and the switch push-rods (38) lying parallel to each other, and an activation slide (43) common to said switch chamber modules (2) and having a cam (66) for moving each switch push-rod (38).

2. The multi-position rotary switch of claim 1 in which each switch chamber module (2) defines the switch chamber (14) and supports respective switch push-rod (38) with a pressure-resistant explosion proof encapsulation.

3. The multi-position rotary switch of claim 1 in which each switch chamber module (2) has at least one fixed switch contact (17, 18) and one movable contact bridge (33).

4. The multi-position rotary switch of claim 3 in which each contact bridge (33) is biased toward a closed position.

5. The multi-position rotary switch of claim 3 in which the contact bridge (33) of each switch chamber module has a longitudinal axis parallel to the mounting sides (8, 9) of the module.

6. The multi-position rotary switch of claim 3 in which the switch contacts (17, 18) of said switch chamber modules (2) have connection tabs (22, 32) extending through to the connection side (12, 13) of the respective module adjacent to the switch contact (17, 18).

7. The multi-position rotary switch of claim 1 including a terminal protection device (51,52) on the connection side (12, 13) of each switch chamber module.

8. The multi-position rotary switch of claim 7, in which each terminal protection device (51, 52) is a clip-on part, and each switch push-rod (38) is captively held in the respective switch chamber module (2).

9. The multi-position rotary switch according to claim 1 in which said connection device (56,57,58,59,61-69) includes at least one projection (56, 57) on one mounting side (7, 8) of each switch chamber module (2) having a dovetail shape in the plan view from the viewpoint of the top side (9), and a complementary dovetail-shaped pocket (58, 59) on the other mounting side (7, 8) of the switch chamber module (2).

10. The multi-position rotary switch according to claim 9 in which the projection (58, 59) is in the bottom side (11) of each switch chamber module.

11. The multi-position rotary switch according to claim 1, in which said connection device (56,57,58,59, 61 . . . 64) of each switch chamber module (2) includes a pocket (61 . . . 64) in the top side (9) of the module, and including an attachment flange (46, 47) having a bottom side flush with the bottom side (11) of the switch chamber module (2) for attachment along a connection side (12, 13) of the module.

12. The multi-position rotary switch of claim 11 including a separate terminal protection device (52, 53) connected to the attachment flange (46, 47) with a positive fit.

13. The multi-position rotary switch of claim 1 including a guide groove (42) in the top side (9) of each switch chamber module (2) in which said activation slide (43) is moveable and into which the switch push rod (38) of the module projects.

14. The multi-position rotary switch of claim 1 in which each switch chamber module (2) has a manual activation mechanism (3) on the top side (9).

15. The multi-position rotary switch of claim 14 in which said activation mechanism (3) includes a bowl-shaped activation housing (71) open in a direction toward the top side (98) of the switch chamber module (2).

16. The multi-position rotary switch of claim 15 in which each activation housing has a bottom side with projections that are engageable with pockets (61 . . . 64) in the top side (9) of the switch chamber module (2) for holding the top side of the switch chamber module (2) together.

17. The multi-position rotary switch of claim 15 in which said activation housings (71) is designed for use with a predetermined number of said switch chamber modules (2), and including a further switch chamber module in addition to said pre-determined number, and an expansion housing (96) associated with the additional module disposed next to the activation housing 71.

18. The multi-position rotary switch of claim 15 in which said activation housing (71) contains a catch mechanism (72).

19. The multi-position rotary switch of claim 18 in which said catch mechanism (72) is star shaped.

20. The multi-position rotary switch of claim 14 in which said manual activation element (3) is a switch shaft.

21. The multi-position rotary switch of claim 20 in which said switch shaft (3) carries teeth (77) that mesh with a toothed rack (78) on the activation slide (43).

22. The multi-position rotary switch of claim 21 in which said activation slide (43) is designed for use with a predetermined number of said switch chamber modules (2), and including a further switch chamber module (2) in addition to said predetermined number, and said activation slide (43) being assembled from a core section and a further extension section 97).

23. The multi-position rotary switch of claim 22 in which said toothed rack (78) is located on the core section in which said activation slide (43) carries an additional switch cam (101, 102) that is activated parallel to a top side of the switch chamber module (2).

24. The multi-position rotary switch of claim 15 in which said activation housing (72) has at least one receptacle space (105) opening outward toward the at least one auxiliary switch unit (106).

* * * * *